United States Patent [19]

Prusak

[11] Patent Number: 4,534,844

[45] Date of Patent: Aug. 13, 1985

[54] ELECTROFORMING APPARATUS

[75] Inventor: John J. Prusak, Indianapolis, Ind.

[73] Assignee: RCA Corporation, Princeton, N.J.

[21] Appl. No.: 678,480

[22] Filed: Dec. 5, 1984

[51] Int. Cl.[3] ..... C25D 1/10; C25D 17/06

[52] U.S. Cl. ..... 204/281; 204/5

[58] Field of Search ..... 204/5, 281

[56] References Cited

U.S. PATENT DOCUMENTS

| | | | |
|---|---|---|---|
| 3,414,502 | 12/1968 | Porrata et al. | 204/218 |
| 4,259,166 | 3/1981 | Whitehurst | 204/279 |
| 4,341,613 | 7/1982 | Prusak et al. | 204/281 |
| 4,385,978 | 5/1983 | Prusak | 204/5 |
| 4,445,995 | 5/1984 | Wierschke | 204/5 |

*Primary Examiner*—Thomas Tufariello

*Attorney, Agent, or Firm*—Birgit E. Morris; Edward J. Sites

[57] ABSTRACT

A cathode head assembly is provided for holding a matrix during electroforming of a replica on the surface of the matrix. The cathode head assembly has a support member with an outer diameter at least as large as the matrix to be replicated; a compressable seal member positioned about the outer diameter of the support member; an outer ring member having means for engaging the seal member and having an inside diameter slightly larger than the outer diameter of the support member and a means for locking the outer ring in a position when the seal is held against the outer ring in compressed sealing engagement with a matrix mounted on the support member.

4 Claims, 4 Drawing Figures

ELECTROFORMING APPARATUS

This invention relates to an apparatus for use in electroforming a replica on a matrix. More particularly, this invention is concerned with a cathode head assembly for use in electroforming the masters, mothers and/or stampers employed in the manufacture of molded records.

BACKGROUND OF THE INVENTION

Molded records, such as conventional audio records and the more recently developed high density information discs, including capacitive electronic discs and optical discs, are mass produced by the same general procedure. The initial step is to record the signal information desired to be reproduced in the molded record or disc on a magnetic tape. The magnetic tape is then used to control a recording apparatus which forms a spiral information track containing the signal information in a substrate.

Once the substrate is recorded, it is used as a matrix on which to electroform one or more replicas referred to as masters which are negative replicas of the recorded substrate. A suitable metal, such as nickel, is electrodeposited on the recorded substrate in an amount sufficient to form self-supporting masters. The masters are then used as matrixes on which to electroform a series of replica parts referred to as mothers which are positive replicas of the recorded substrate. Each of the mothers is in turn used as a matrix on which to electroform a series of parts referred to as stampers which are negative replicas of the recorded substrate. It is the stampers which are eventually used in a molding process to press the signal information originally recorded in the substrate into the molded record or disc.

Considerable problems are encountered in the electroforming which can adversely affect the quality of the molded records or discs. The matrix to be replicated, albeit, a recorded substrate, master, or mother, is attached to a cathode head assembly and is then immersed in an electrolyte bath. During electroforming, electrolyte often leaks to the back of the matrix being replicated and causes a variety of problems including a condition known as "back plating," which results in metal being deposited on the back surface of the matrix which can damage the matrix and cause highly undesirable distortion of the recorded surface.

Most of the problems encountered as a result of leakage of electrolyte can be traced directly to the cathode head assemblies employed in electroforming and/or operator error mounting the matrix on the cathode head assemblies. The cathode head assemblies typically employed in the prior art have a casing or support made of a dielectric material, such as rubber, on which the matrix is mounted, with electrical contact being made between the matrix and the cathode of the electroforming apparatus.

What would be highly advantageous would be a cathode head assembly which, when assembled, would consistently provide an electrolyte tight seal of a matrix to be replicated to the cathode head and which after electroforming of a replica on a matrix could readily be disassembled for removal of the replica from the matrix without damage to the matrix or replica.

SUMMARY OF THE INVENTION

A cathode head assembly is provided for holding a matrix during electroforming of a replica on the surface of the matrix. The cathode head assembly has a support member with an outer diameter at least as large as the matrix to be replicated; a compressable seal member positioned about the outer diameter of the support member; an outer ring member having means for engaging the seal member and having an inside diameter slightly larger than the outer diameter of the support member and a means for locking the outer ring in a position when the seal is held against the outer ring in compressed sealing engagement with a matrix mounted on the support member.

DETAILED DESCRIPTION OF THE INVENTION

Figure 1:
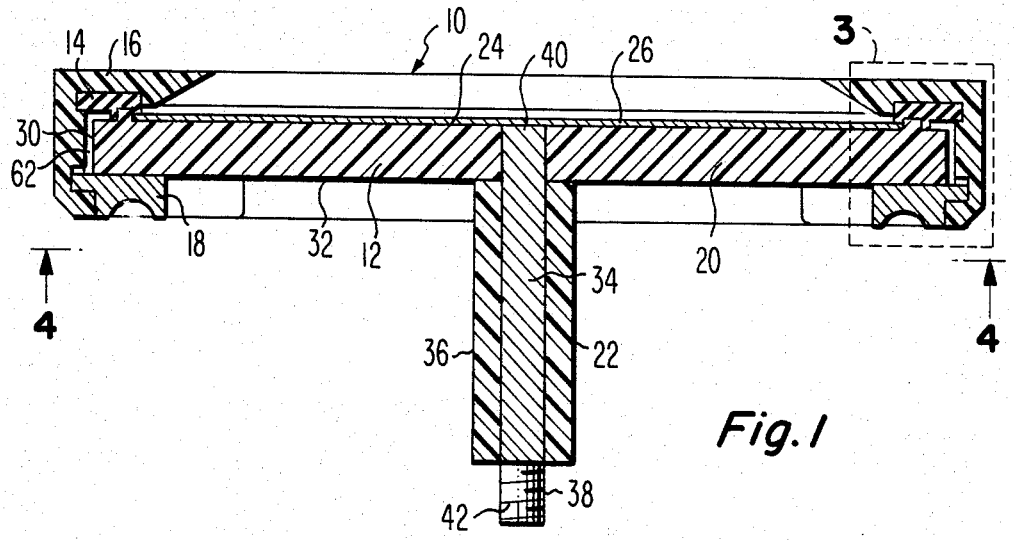
FIG. 1 is a cross-sectional illustration of the cathode head assembly of this invention.

The cathode head assembly of this invention 10 is comprised of a support member 12, a compressable seal member 14, a ring member 16, and a lock member 18.

Figure 2:
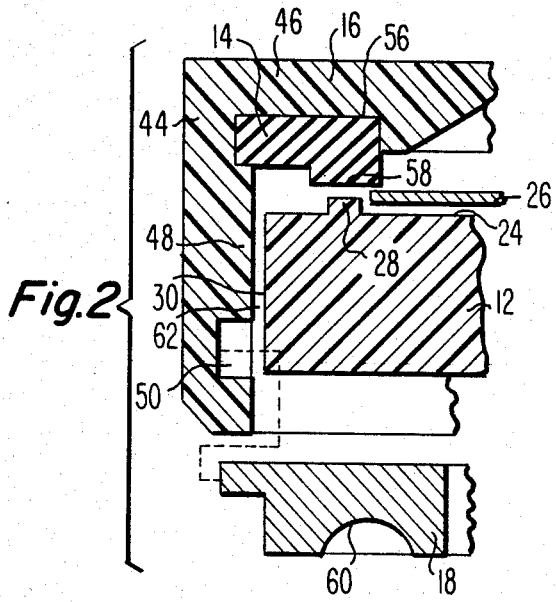
FIG. 2 is an enlarged cross-sectional illustration of an edge portion of the cathode head assembly of FIG. 1 shown partially disassembled.
Figure 3:
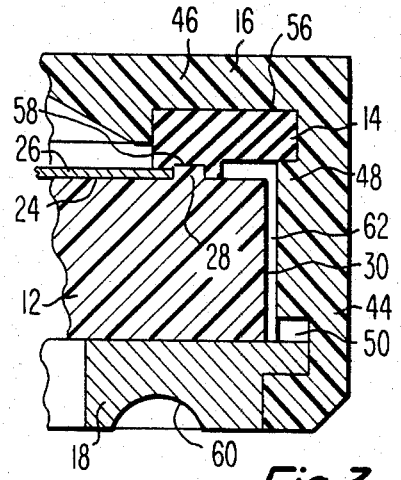
FIG. 3 is an enlarged cross-sectional illustration of the fully assembled cathode head assembly of FIG. 1 taken as indicated by the dotted outline 3 in FIG. 1.

The support member 12 has a disc-shaped portion 20 and a connecting shaft 22. The disc-shaped portion 20 has a flat face 24 for receiving a flat matrix 26 to be replicated and is of a diameter slightly larger than the diameter of the matrix 26 to be replicated. In the preferred embodiment of this invention 10, as best seen in FIGS. 2 and 3, a raised boss 28 is provided adjacent the outer diameter edge 30 of the disc-shaped portion 20 at a distance intermediate between the outermost diameter edge 30 of the disc-shaped member 20 and the anticipated position of the outer diameter edge of a matrix 26 to be replicated. The function of this optional boss 28 will be explained in greater detail below. The outer diameter edge 30 of the disc-shaped portion 20 is of a predetermined diameter, and the disc-shaped member 20 is of a predetermined thickness so as to allow the outer ring member 16 to be slid past the outer diameter edge 30 of the disc-shaped portion 20 and then to be locked into position relative to the disc-shaped portion 20, as will be explained below. The disc-shaped portion 20 is comprised of a relatively rigid dielectric material, such as a polyester plastic. The support member 12 likewise includes a connecting shaft 22. The connecting shaft 22 is secured in electrolyte tight fit to the center of the disc-shaped portion 20 and extends outwardly from the bottom surface 32 of the disc-shaped portion 20. The connecting shaft 22 has an electrically conductive center rod 34 and an outer insulated layer 36. At the terminal end 38 of connecting shaft 22, which is adjacent to the face surface 24 of the disc-shaped portion 20, the center rod 34 is exposed so as to make electrical contact with the matrix 26 which is to be replicated. At the opposite terminal end 40 of the connecting shaft 22, the insulation is removed and the center rod 24 is cut with a male thread 42 so that it can be mechanically and electrically connected to a cathode of an electroforming apparatus (not shown).

The ring member 16 is made of a strong rigid dielectric material, such as a polyester plastic similar to that used to form the support member 12. The ring member 16 has a generally inverted ell-shaped cross-sectional configuration with an integral cylindrical portion 44 and a radially inwardly extending portion 46. The inner diameter 48 of the cylindrical portion 44 has a diameter slightly larger than the outer diameter of the disc-shaped portion 20 so as to be slidable past the outer diameter edge 30 of the disc-shaped portion 20. The cylindrical portion 44 also has a height sufficient to extend past the bottom edge surface 32 of the disc-shaped portion 20 for a predetermined distance. A locking groove 50 is cut into the inner diameter 48 at the lower area of the cylindrical portion 44 of the ring member 16. The function of this locking groove 50 will be explained in greater detail hereinafter. The radially inwardly extending portion 46 projects inwardly over the outer edge portion 52 of the disc-shaped portion 20 to a point above the matrix 26. The inner edge 54 of the radially inwardly extending portion 46 is tapered toward the flat face surface 24 at about 30° of the support member 12 so as to form a plating mask when electroforming a replica on the matrix 26. A rectangular groove 56 is cut about the entire diameter of the inwardly extending portion 46 for receiving and holding the compressable seal member 14.

The compressable seal member 14 is made of a compressable highly resiliant rubber-like material which is resistant to the chemicals and processing conditions encountered in electroforming, with silicon rubber generally being satisfactory for this purpose. As illustrated, the compressable seal member 14 is of a generally rectangular cross-sectional configuration and is sized to fit into the rectangular groove 56 formed in the radially inwardly extending portion 46 of the ring member 16. The compressable seal member 14 is positioned so as to engage the outer edge portion of a matrix 26 to be replicated. As best seen in FIG. 2 in the preferred embodiment, the compressable seal member 14 also includes an integral smaller retangular section 58 which is positioned so as to be centered over the raised boss 28 formed on the face surface 24 of the disc-shaped member 20 when the ring member 16 is positioned over the disc-shaped member 20.

The lock members 18 are of a generally chordal shape having a curvature which mates with the curvature of the locking groove 50 formed in the cylindrical portion 44 of the ring member 16. Advantageously, two or more locking members 18 are employed to balance the locking forces about the diameter of the ring member 16. However, it is possible to use a single locking member 18 provided it can hold the locking ring 16 in electrolyte tight sealing engagement during electroforming. The locking members 18 are preferably made of a relatively strong material which is resistant to the conditions encountered in electroforming, with metals such as titanium and stainless steel being preferable. The locking members 18 further include hand holds 60 for facilitating insertion and removal of the locking members 18 into and out of the locking groove 50. Other locking means can likewise be employed, such as lock pins which extend through the outer ring and engage the disc-shaped member 12 and the like.

In use, a matrix 26 to be replicated is centered on the flat face surface 24 of the disc-shaped portion 20 of the support member 12. If the disc-shaped portion 20 has a raised boss 28, the outer edge of the matrix 26 is aligned circumferentially with the raised boss 28. The compressable seal member 14 is positioned within the rectangular groove 56 formed in the ring member 16 with the rectangular section 58, if employed, being in the downward position. The ring member 16 is then slid over the outer diameter edge 30 of the disc-shaped portion 20 of the support member 12. As can be seen best in FIGS. 2 and 3, there is a slight space 62 between the outer diameter edges 30 of the disc-shaped portion 20 and the inner diameter 48 of the ring member 16 allowing the ring member 16 to move in a normal direction with respect to the surface 24 of the support member 12. The cathode head 10 is illustrated in FIG. 2 in the partially dissembled state.

To complete the assembly of the cathode head 10, the partially assembled cathode head, as shown in FIG. 2, is placed in a suitable press means (not shown). The bottom surface 32 of the disc-shaped portion 20 is supported in the press and pressure is applied to the radially inwardly extending portion 46 of the ring member 16. The pressure which is applied causes the resiliant seal member 14 to be compressed significantly and to be forced into sealing engagement with the matrix 26 to be replicated. When the support member 12 includes the raised boss 28 and when the compressable seal member 14 includes the rectangular section 58 on the lower surface of the seal member 14, the seal member 14 will form about the raised boss 28 to establish an exceptionally tight bond of the seal member 14 to the matrix 26 which blocks the flow of electrolyte to the back of the matrix 26, both from the space 62 between the ring member 16 and the support member 12 and from the face surface of the matrix 26.

Figure 4:
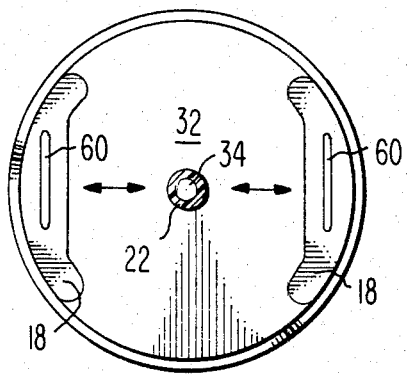
FIG. 4 is bottom plan view in partial cross-section of the cathode head assembly of FIG. 1 taken as indicated by the line and arrow 4 on FIG. 1.

The partially assembled cathode head is compressed a sufficient amount so that the locking groove 50 is forced past the bottom surface 32 of the disc-shaped portion 20. The lock members 18 are then slid into position as best shown in FIG. 4. The pressure of the press is relieved allowing the compressable seal member 14 to re-expand slightly and thereby hold the lock members 18 into position as shown in FIG. 3 while still maintaining the electrolyte tight seal.

The assembled cathode head 10, with the matrix 26 in position, is then transferred to an electroforming apparatus (not shown). The male thread 42 of the connecting shaft 22 is screwed into and locked in engagement with a mating female thread of the cathode of the electroforming apparatus. The electroforming of a replica on the matrix 26 is then conducted in the conventional manner.

After electroforming of the replica (not shown) is completed, the assembled cathode head 10 is removed from the electroforming apparatus. The cathode head assembly 10 is then placed back into the press, and pressure is applied to the outer ring to recompress the seals so as to allow the ring member 16 to advance it a sufficient distance past the disc-shaped portion 20 to allow the lock members 18 to be released. The lock members 18 are removed and the pressure is completely released allowing the compressable seal member 14 to fully re-expand to its original shape. The ring member 16 is then removed by simply sliding it past the outer diameter edge 30 of the disc-shaped portion 20 in a direction normal to the face surface 24 of the disc-shaped portion 20. The matrix 26, with the replica formed on the surface, is then lifted off the face surface 24 of the disc-shaped portion 20 and separated at a separate work station by well-known means. Once the replica is removed from the matrix 26, the matrix 26 is replaced on the disc-shaped portion 20 and the process is repeated until a sufficient number of replicas are formed.

Using the cathode head assembly of this invention 10, superior results are obtained. Exceptional sealing of the matrix 26 to the cathode head 10 are obtained consistently so that electrolyte leaks are not encountered with the cathode head of this invention 10. Furthermore, since the force of expansion of the compressable seal member 14 determines the force with which the ring member 16 and seal member 14 are held in contact with the matrix 26, uniform results are obtained from replication to replication. Operator errors and subjective differences in operator practice in assembling the cathode head assemblies are virtually eliminated. A further very substantial advantage of the cathode head assembly of this invention 10 is that the ring member 16 with the compressable seal member 12 are applied and removed in a direction which is normal with respect to the surface of support member 12 so that the seal member 14 is not cut or damaged in use allowing elongated use of the compressable seal members 14 and production of high quality masters, mothers and stampers.

What is claimed is:

1. A cathode head assembly for holding a matrix of a given diameter comprising:

a disc-shaped support member having an outer diameter which is at least as large as the given diameter;

a circular seal member comprised of a compressable elastic material having an inside diameter less than the given diameter of the matrix and an outer diameter the same or less than the outer diameter of the support member, said seal member being positioned adjacent the outer diameter of the support member with the inner diameter edge being aligned to sealingly engage a matrix when positioned on the support member;

a ring member having a radially inwardly extending portion in engagement with the seal member and a downward extending cylindrical portion with an inside diameter larger than the outer diameter of the support member which is cylindrically aligned with the outer diameter of the support member; and lock means associated with the ring member for holding the ring member in a position where the radially inwardly extending portion of the ring member holds the seal member in a compressed electrolyte tight sealing engagement.

2. The cathode head assembly according to claim 1 wherein the seal member has a predetermined cross-sectional configuration and is held in position in a mating groove formed in the radially inwardly extending portion of the ring member.

3. The cathode head assembly according to claim 1 wherein the support member has a raised circumferential boss intermediate the outer diameter of the support member and the diameter of a matrix to be replicated and wherein the seal member has a proturbance aligned with the boss.

4. The cathode head assembly according to claim 1 wherein the lock means is comprised of a retaining groove formed in the cylindrical portion of the ring member and a removable mating member having a portion thereof positioned within the retaining groove and a portion in engagement with the support so as to lock the ring member in a fixed position relative to the support member.

* * * * *